US007708384B2

(12) United States Patent
Sugahara

(10) Patent No.: US 7,708,384 B2
(45) Date of Patent: May 4, 2010

(54) PRINTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 833 days.

(21) Appl. No.: 11/493,571

(22) Filed: Jul. 27, 2006

(65) Prior Publication Data

US 2007/0024669 A1 Feb. 1, 2007

(30) Foreign Application Priority Data

Jul. 27, 2005 (JP) ..... 2005-216922

(51) Int. Cl.
*B41J 2/06* (2006.01)

(52) U.S. Cl. ..... 347/55

(58) Field of Classification Search ..... 347/5, 347/55, 103

See application file for complete search history.

(56) References Cited

U.S. PATENT DOCUMENTS

| | | | | |
|---|---|---|---|---|
| 4,855,768 | A | 8/1989 | Iino et al. | |
| 5,486,337 | A | 1/1996 | Ohkawa | |
| 5,539,440 | A * | 7/1996 | Higuchi et al. | 347/112 |
| 5,992,820 | A | 11/1999 | Fare et al. | |
| 6,557,979 | B2 * | 5/2003 | Ohsawa et al. | 347/55 |
| 6,926,382 | B2 | 8/2005 | Ito et al. | |
| 7,422,311 | B2 * | 9/2008 | Sugahara | 347/54 |
| 2004/0145632 | A1 * | 7/2004 | Lee et al. | 347/55 |

FOREIGN PATENT DOCUMENTS

| | | | |
|---|---|---|---|
| DE | 3811141 | A1 | 10/1988 |
| EP | 0049843 | A2 | 4/1982 |
| EP | 1550556 | A1 | 7/2005 |
| EP | 1582351 | A1 | 10/2005 |
| JP | 2000-190507 | A | 7/2000 |
| JP | 2003177219 | | 6/2003 |
| JP | 2003326712 | | 11/2003 |
| JP | 2004114377 | | 4/2004 |

OTHER PUBLICATIONS

European Patent Office, European Search Report for Related EP Application No. 06015598 dated Oct. 30, 2006.

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

A printing apparatus which discharges an electroconductive ink includes an ink transporting head having a head main body in which a discharge port and an individual ink channel are formed, an individual electrode which is formed on a surface defining the individual ink channel, and an insulating layer which covers the individual electrode, and a transfer drum which is rotatably supported. When a drive voltage is applied to the individual electrode, since a liquid repellent property of the insulating layer is declined due to an electrowetting phenomenon, the ink is discharged from the discharge port. Furthermore, a distance between the discharge port and the transfer drum is less than a diameter of a liquid droplet equivalent to a liquid discharged at a time from the discharge port. Accordingly, it is possible to provide a printing apparatus having a simple structure, and of which a size can be reduced easily.

12 Claims, 19 Drawing Sheets

PRINTING APPARATUS

CROSS REFERENCE TO RELATED APPLICATION

The present application claims priority from Japanese Patent Application No. 2005-216922, filed on Jul. 27, 2005, the disclosure of which is incorporated herein by reference in its entirely.

BACKGROUND OF THE INVENTION

1. Field of the Invention

The present invention relates to a printing apparatus which performs printing by transporting a liquid onto a printing medium such as a recording paper 2. Description of the Related Art A printing apparatus which includes an ink-jet head discharging an ink on to a printing medium, has been hitherto used widely as a printing apparatus which performs printing on various printing media such as a recording paper. Here, printing apparatuses with various structures of the ink-jet head are available, and a printing apparatus in which an ink-jet head includes a channel unit provided with a plurality of individual ink channels including a pressure chamber communicating with a nozzle, and a piezoelectric actuator which applies a pressure to an ink in the pressure chamber is an example of such printing apparatus (refer to U.S. Pat. No. 6,926,382 (corresponding to Japanese Patent Application Laid-open No. 2003-326712)).

A general piezoelectric actuator includes a plurality of individual electrodes corresponding with a plurality of pressure chambers, a common electrode facing the individual electrodes, and a piezoelectric layer sandwiched between the individual electrode and the common electrode, which is formed by a piezoelectric material such as lead zirconate titanate (PZT). Moreover, when a drive voltage is supplied to a predetermined individual electrode, an electric field is generated in a portion of the piezoelectric layer sandwiched between the individual electrode and the common electrode. As the electric field is generated, the piezoelectric layer is deformed partially, and with the deformation of the piezoelectric layer, a pressure is applied to the ink in the pressure chamber. As the pressure is applied to the ink, the ink is discharged from the nozzle communicating with the pressure chamber.

SUMMARY OF THE INVENTION

However, in the ink-jet head mentioned above, an actuator in which a plurality of individual ink channels of a complicated shape, in which a channel unit includes a nozzle and a pressure chamber, is formed, and a plurality of individual electrodes, a common electrode, and a piezoelectric layer are provided on a surface of the channel unit, is arranged. Since such structure is quite complicated, there is an increase in a manufacturing cost. Moreover, for discharging a certain amount of ink, it is necessary to ensure a volume of the pressure chamber more that a predetermined quantity. Therefore, it is difficult to arrange densely (compactly) the individual ink channels of the complicated shape which include the nozzle and the pressure chamber, in the channel unit (it is difficult to have highly integrated individual ink channels of the complicated shape, in the channel unit).

An object of the present invention is to provide a printing apparatus having a simple formation, and of which a size can be reduced easily.

According to a first aspect of the present invention, there is provided a printing apparatus which performs printing by discharging an electroconductive liquid onto a printing medium, including a liquid transporting section which includes a channel forming surface on which a liquid channel through which the liquid flows, and a discharging section communicating with the channel unit are formed, a first electrode which is arranged on the channel forming surface, and an insulating layer formed on a surface of the electrode, which has a liquid repellent property higher than a liquid repellent property of the channel forming surface when a voltage is applied to the first electrode, and a transferring mechanism which transfers the liquid discharged from the discharging section of the liquid transporting section, to the printing medium.

According to the first aspect of the present invention, the liquid transporting section transports the liquid up to the discharging section by using a phenomenon in which, when there is an electric potential difference developed between the first electrode and the liquid, the liquid repellent property (wetting angle of the liquid) of the insulating layer on the surface of the first electrode is declined (electrowetting phenomenon: refer to Japanese Patent Application Laid-open No. 2003-177219). Therefore, as compared to the conventional ink-jet head having the complicated structure, the structure of the liquid channel and a formation of the actuator transporting the liquid are simplified, and it is possible to arrange the liquid channels and the discharging section highly densely, thereby facilitating to reduce the size of the liquid transporting section. Moreover, it is possible to transport the liquid at a comparatively lower drive voltage.

In the printer of the present invention, a distance between the discharging section of the liquid transporting apparatus and the transferring mechanism may be less than a diameter of a liquid which is discharged at one time from the discharging section. The transferring mechanism may be a transfer drum, and the transfer drum may be rotatably supported such that a surface of the transfer drum is close to the discharging section of the liquid transporting section.

Particularly, in a case in which the printing medium is a medium having a large number of minute recesses and projections on a surface, when the liquid discharged from the discharging section is let to be adhered directly to the printing medium, it is difficult to make the uniform amount of ink to be adhered stably due to the roughness on the surface of the printing medium, and there is a possibility of decline in a printing quality due to a variation in an amount of liquid adhered. However, in the printing apparatus of the present invention, after the ink is allowed to be adhered once on the surface of the transfer drum from the liquid transporting section, the transfer drum is rotated and the ink on the surface of the transfer drum is transferred to the printing medium. Therefore, it is possible to make the uniform amount of the liquid to be adhered stably to the printing medium. Moreover, since the distance between the discharging section of the liquid transporting apparatus and the transferring mechanism is less than the diameter of the liquid which is discharged at a time from the discharging section, the liquid which is discharged from the discharging section is adhered assuredly to the transfer drum.

Here, "the diameter of the liquid which is discharged at a time from the discharging section" means a diameter of a liquid drop having a spherical shape having a volume same as a volume of the liquid discharged at a time from the discharging section.

In the printing apparatus of the present invention, the liquid repellent property of the surface of the transfer drum may be lower than a liquid repellent property of an area around the discharging section of the liquid transporting section. In this case, the liquid discharged from the discharging section is not adhered to the area around the discharging section, and is transferred assuredly to the surface of the transfer drum.

In the printing apparatus of the present invention, the surface of the transfer drum may be provided with a liquid adhering area to which the liquid discharged from the discharging section is adhered, and a highly liquid repellent area surrounding the liquid adhering area, which has a liquid repellent property higher than a liquid repellent property of the liquid adhering area. In this case, on the surface of the transfer drum, even when the liquid is shifted away from an original liquid adhering position at which the liquid is supposed to be adhered, and adhered spreading across up to the highly liquid repellent area, the liquid moves naturally from the highly liquid repellent area having a superior (higher) liquid repellent property, to a liquid adhering position having an inferior liquid repellent property. Therefore, an adhering position of liquid droplets on the surface of the transfer drum is corrected, and a printing quality when the liquid is transferred to the printing medium, is improved.

In the printing apparatus of the present invention, a second electrode which is kept at a predetermined electric potential all the time, and which is in direct contact with the liquid may be formed on the channel forming surface of the liquid channel. In this case, an electric potential of the liquid in the liquid channel is fluctuated, and it is possible to generate assuredly a predetermined electric potential difference between the first electrode and the liquid, when a voltage is applied to the first electrode.

In the printing apparatus of the present invention, the liquid transporting section may transport the liquid vertically downward from the discharging section toward the transfer drum. In this case, the adhering position of the liquid on the surface of the transfer drum is not shifted due to a gravitational force acting on the liquid discharged from the discharging section.

In the printing apparatus of the present invention, the liquid transporting section may include a plurality of individual liquid transporting sections arranged in a circumferential direction (arranged along a circumference) of the transfer drum. In this case, various types of liquids can be discharged from the liquid transporting section, and made to be adhered to the transfer drum.

The printing apparatus of the present invention, may further include a foreign-matter removing mechanism (an impurity removing mechanism) which removes foreign matters (impurities) adhered to the surface of the transfer drum. In this case, it is possible to remove assuredly foreign matters such as paper dust adhered to the transfer drum.

In the printing apparatus of the present invention, the transferring mechanism may be a transfer belt, and a hole into which the liquid discharged from the liquid discharging section is filled may be formed in the transfer belt. In this case, it is possible to arrange the transfer belt in any shape. Moreover, when the hole is formed in the transfer belt, with the liquid discharged from the discharged section filled in this hole, the ink can be carried up to a point of transferring to the recording medium. Therefore, the position of the liquid on the surface of the transfer belt is not shifted.

The printing of the present invention may further include a foreign-matter removing mechanism which removes foreign matters adhered to a surface of the transfer belt. In this case, it is possible to remove assuredly impurities such as paper dust adhered to the transfer belt.

DETAILED DESCRIPTION OF THE PREFERRED EMBODIMENTS

Next, an embodiment of the present invention will be described below. This embodiment is an example in which the present invention is applied to a printing apparatus which performs printing by transporting an ink to a recording paper.

Figure 1:
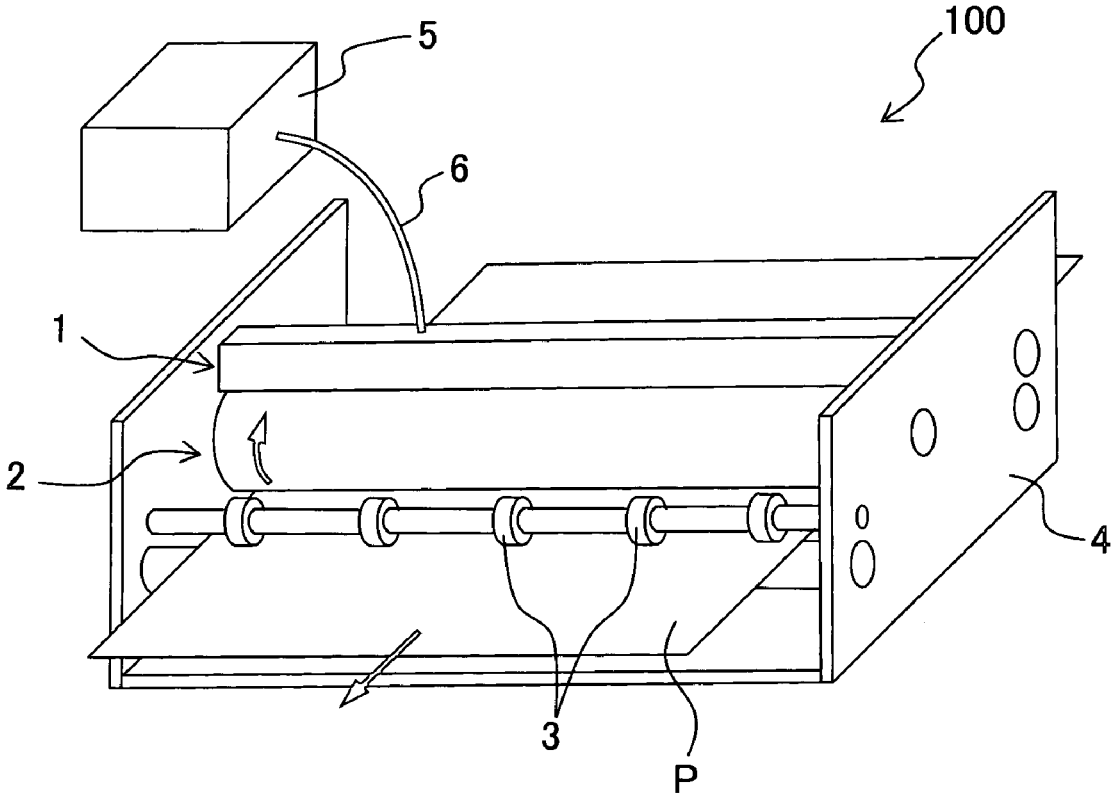
FIG. 1 is a schematic structural diagram of a printer according to an embodiment of the present invention.
Figure 2:
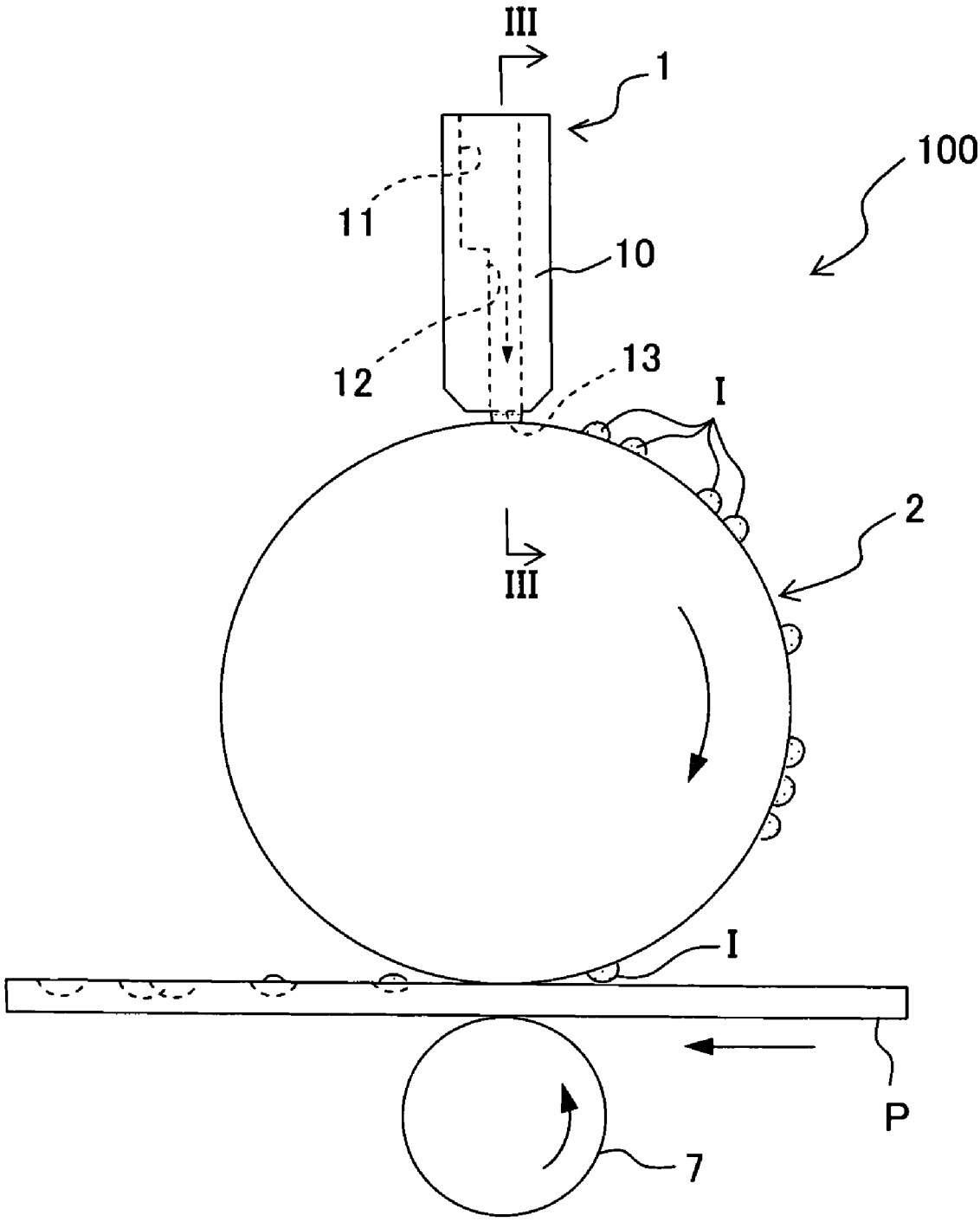
FIG. 2 is a side view of main components of the printer in FIG. 1.

Firstly, a schematic structure of a printer 100 of this embodiment will be described below. As shown in FIG. 1 and FIG. 2, the printer 100 includes an ink transporting head 1 (liquid transporting section), a transfer drum 2, and transporting rollers 3. The ink transporting head 1 includes a plurality of individual ink channels 12 through which an electroconductive ink flows, and a plurality of discharge ports 13 (discharging sections) communicating with the individual ink channels 12. The transfer drum 2 on a lower side of the ink transporting head 1, has a circular cylindrical shape and is rotatably supported by a frame 4 such that a surface of the transfer drum 2 is close (approximated) to the discharge port 13 of the ink transporting head 1. The transporting rollers 3 carry in a forward direction in FIG. 1, a recording paper P which is in contact with a lower edge of the transfer drum 2. The electroconductive ink used in this printer 100 is an aqueous dye ink having water as a main constituent and a dye and a solvent added therein, or an aqueous pigment ink having water as a main constituent and a pigment and a solvent added therein.

The ink transporting head 1 is connected to an ink tank 5 via a tube 6. Moreover, ink supplied from the ink tank 5 to the ink transporting head 1 upon passing through the individual ink channels 12 in the ink transporting head 1 is discharged from the discharge ports 13 opening on a lower side, and is adhered to the surface of the transfer drum 2 rotating in a fixed direction (clockwise direction in FIG. 2). Furthermore, the recording paper P, supported by a roller 7, on the lower side of the transfer drum 2 is in contact with the lower edge of the transfer drum 2. Therefore, an ink I which is adhered to the transfer drum 2 is moved to the lower side with rotation of the transfer drum 2, and transferred to the recording paper P. Thus, a predetermined image is recorded on the recording paper P. After recording the image on the recording paper P, the recording paper P is discharged forward by the transporting rollers 3. As shown in FIG. 1, the ink transporting head 1 and the transfer drum 2 are installed along an entire (direction of) width of the recording paper P, when the ink is transferred from the transfer drum 2 to the recording paper P, a row (line) of pixels arranged in the direction of width are recorded at a time on the recording paper P. In other words, the printer 100 of this embodiment is a line printer.

Figure 3:
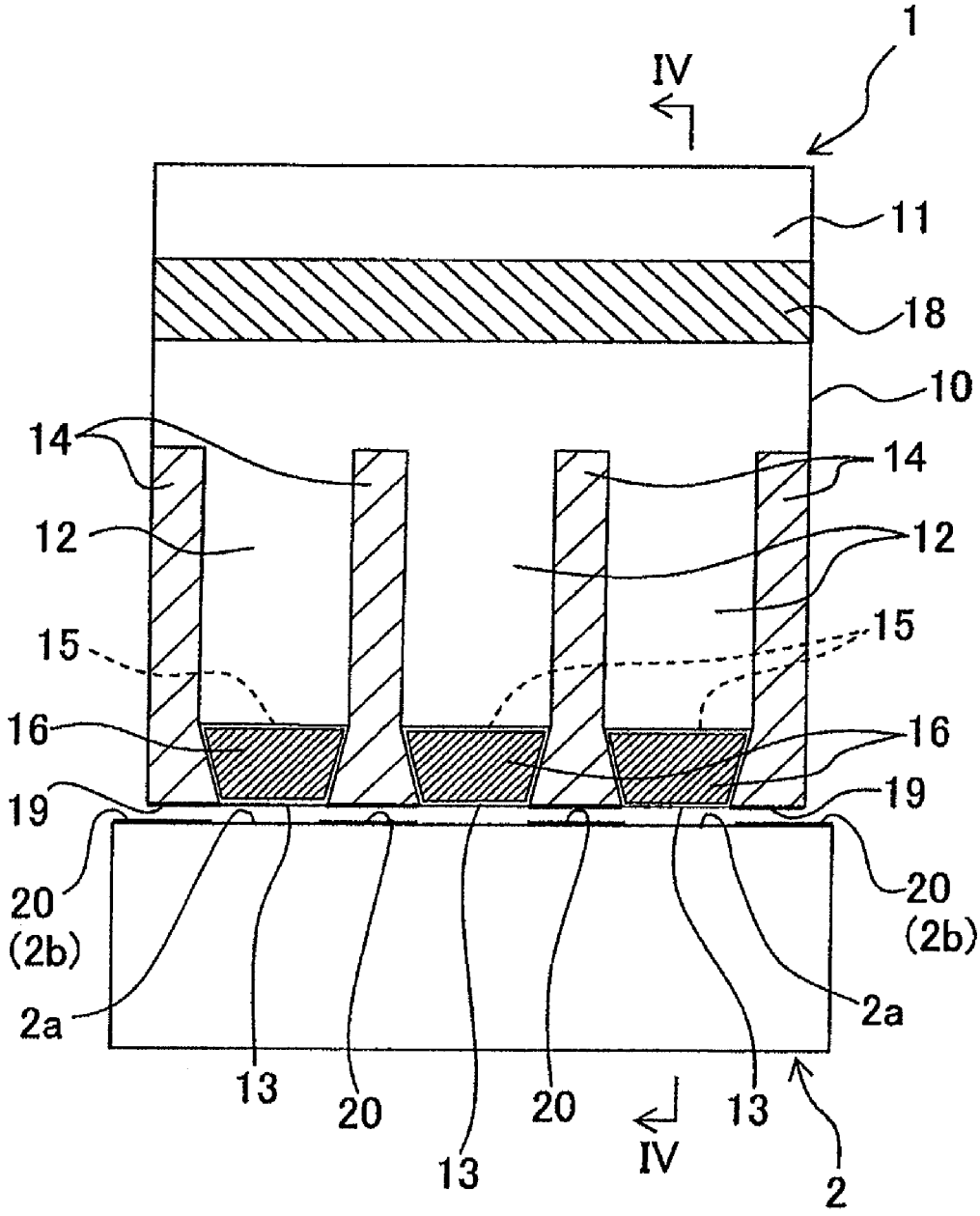
FIG. 3 is a cross-sectional view taken along a line III-III shown in FIG. 2.
Figure 4:
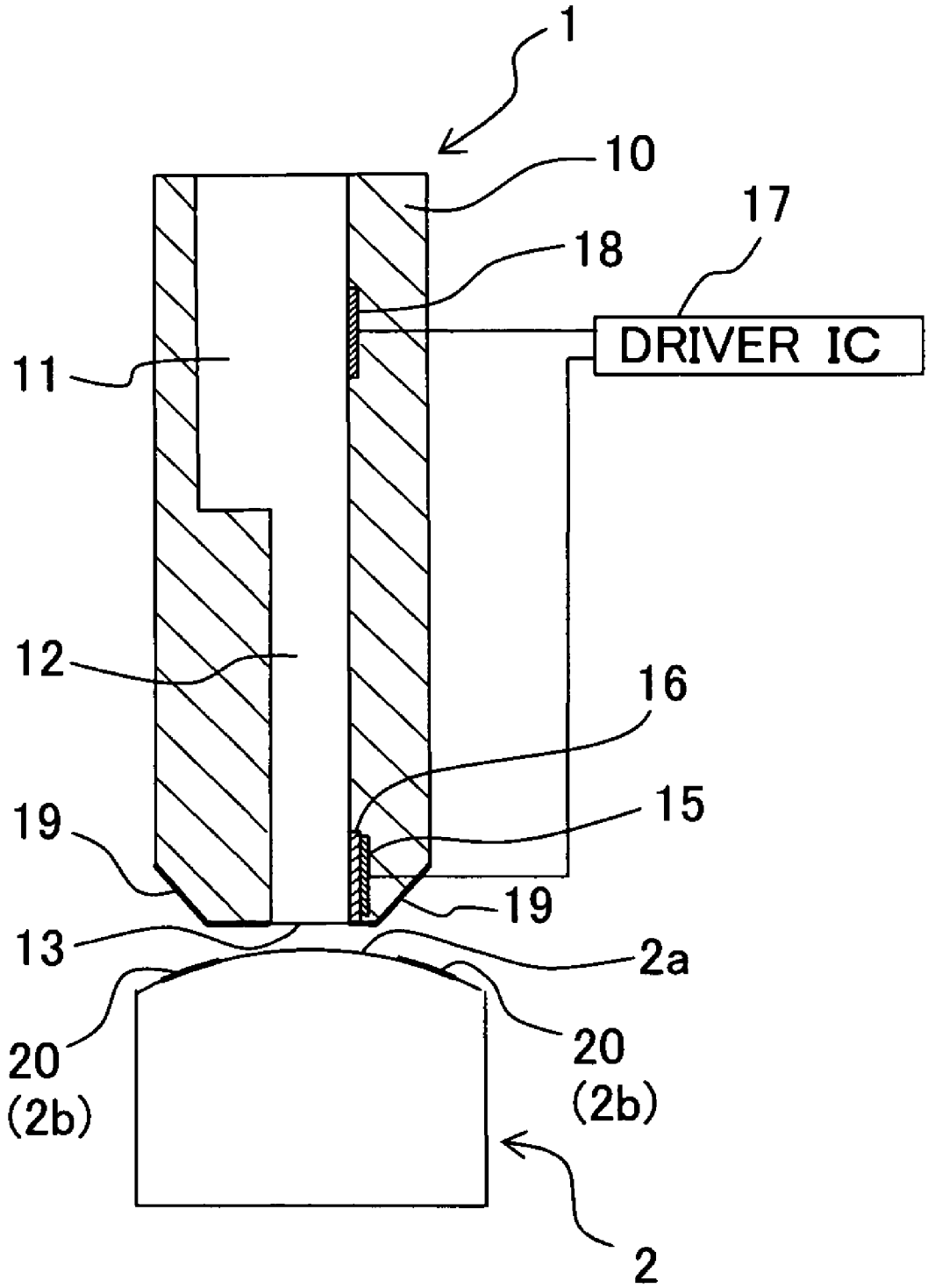
FIG. 4 is a cross-sectional view taken along a line IV-IV shown in FIG. 3.

Next, the ink transporting head 1 will be described in detail. As shown in FIG. 3 and FIG. 4, the ink transporting head 1 includes a head main body 10. A manifold 11 extending in a longitudinal direction of the ink transporting head 1 (left and right direction in FIG. 3) is formed on an upper half portion of the head main body 10. Moreover, the individual ink channels 12 extending toward a lower side upon branching from the manifold 11 are formed to be arranged in the longitudinal direction of the ink transporting head 1. The individual ink channels 12 are separated mutually by partition walls 14. Only three individual ink channels 12 which are a part of the individual ink channels 12 formed in the head main body 10 are shown in FIG. 3. Moreover, a lower end portion of each of the individual ink channels 12 is tapered toward a front end, the discharge port 13 having an opening on the lower side is provided on the front end.

The manifold 11 is connected to the ink tank 5 (refer to FIG. 1), and the electroconductive ink is supplied from the ink tank 5 to each individual ink channel 12 via the manifold 11. Here, a gravitational force acts all the time in a downward direction on the ink in each individual ink channel 12 extending in a downward direction. The manifold 11 and the individual ink channels 12 correspond to the liquid channel of the invention in this application.

On one surface of an inner surface (channel forming surface) of the head main body 10, which forms a lower end portion having a tapered shape of each individual ink channel 12, an individual electrode 15 (a first electrode) having a trapezoidal shape substantially covering this surface is formed. As shown in FIG. 4, each individual electrode 15 is connected to a driver IC 17, and it is possible to apply a predetermined drive voltage to each individual electrode 15 by the driver IC 17. Furthermore, on surfaces of the individual electrodes 15, an insulating layer 16 made of a fluororesin is provided so as to cover completely the individual electrodes 15. Here, when the drive voltage is not applied to the individual electrodes 15, a liquid repellent property (a liquid repellence) of a surface of the insulating layer 16 is higher than a liquid repellent property of the inner surface of the individual ink channel 12. The insulating layer 16 can be formed by coating a fluororesin on the surfaces of the individual electrodes 15 by a method such as a spin coating.

On one of surfaces (right side surface in FIG. 4) of the inner surface of the manifold 11 (channel forming surface), a common electrode 18 (second electrode) which is in direct contact with the ink in the manifold 11 is formed. This common electrode 18 is also connected to the driver IC 17, and the common electrode 18 is kept at a ground electric potential all the time via the driver IC 17. Consequently, the ink in the manifold 11, which is in contact with the common electrode 18, is kept at the ground electric potential all the time.

Figure 5:
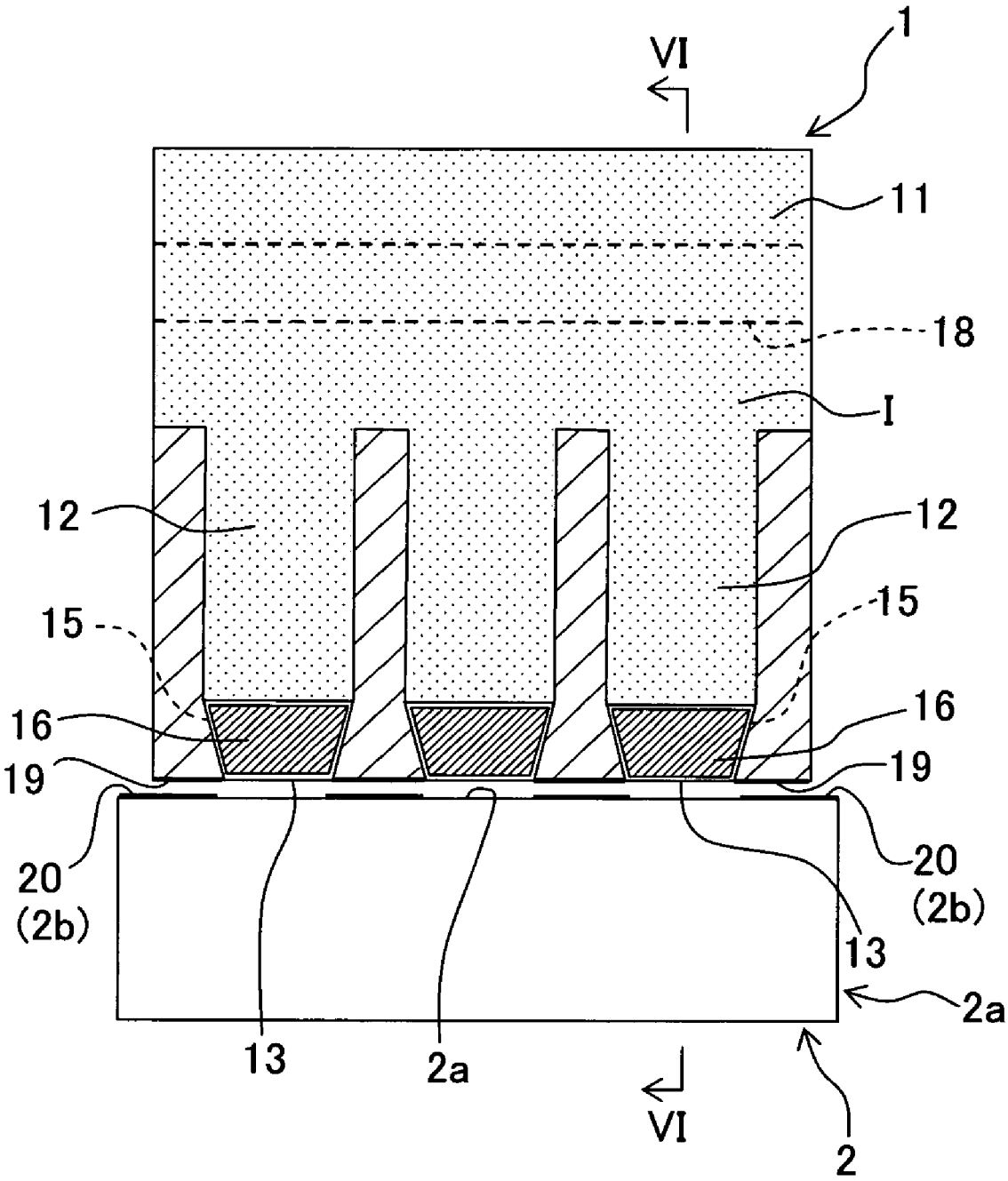
FIG. 5 is a cross-sectional view corresponding to FIG. 2 in a state in which ink is not discharged.
Figure 6:
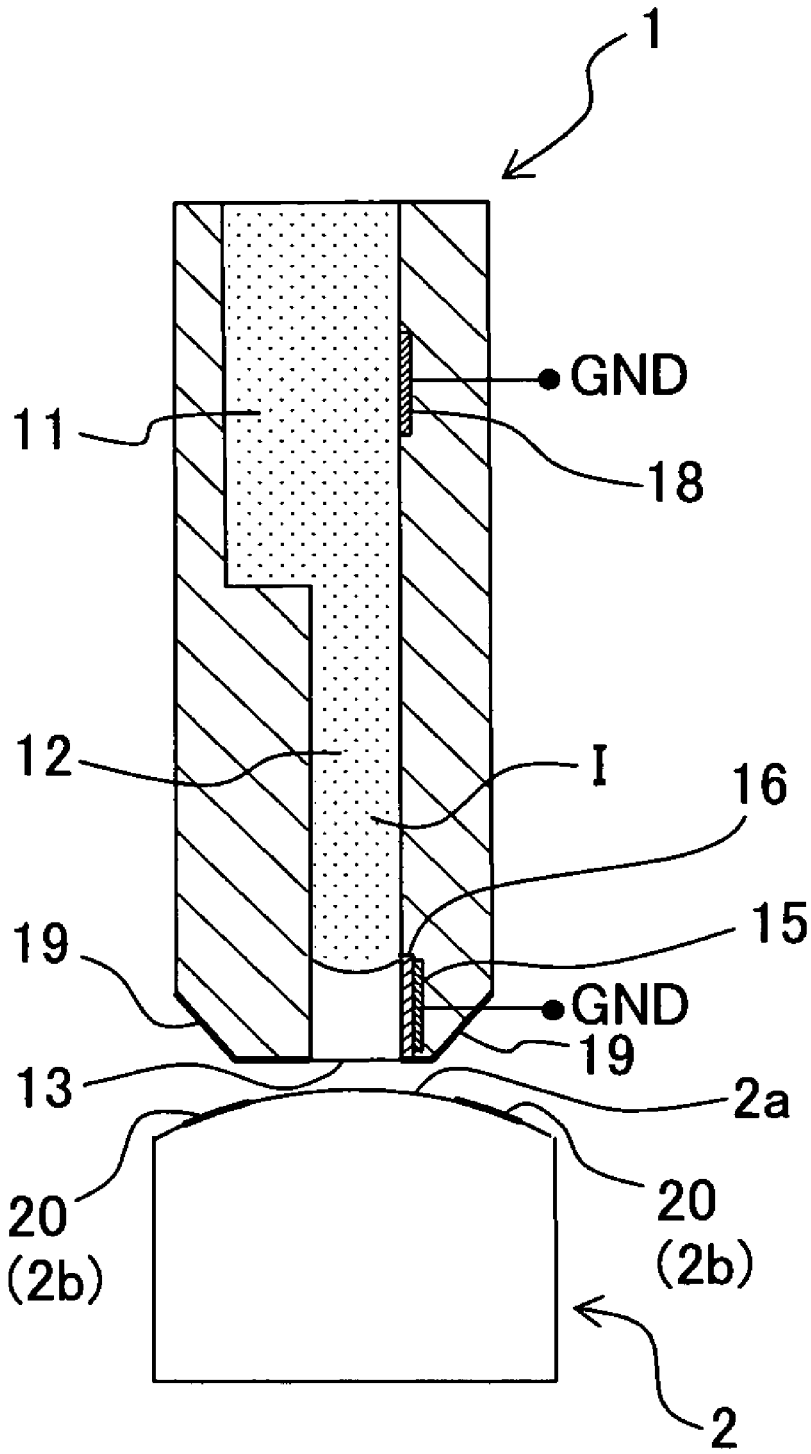
FIG. 6 is a cross-sectional view taken along a line VI-VI shown in FIG. 5.
Figure 7:
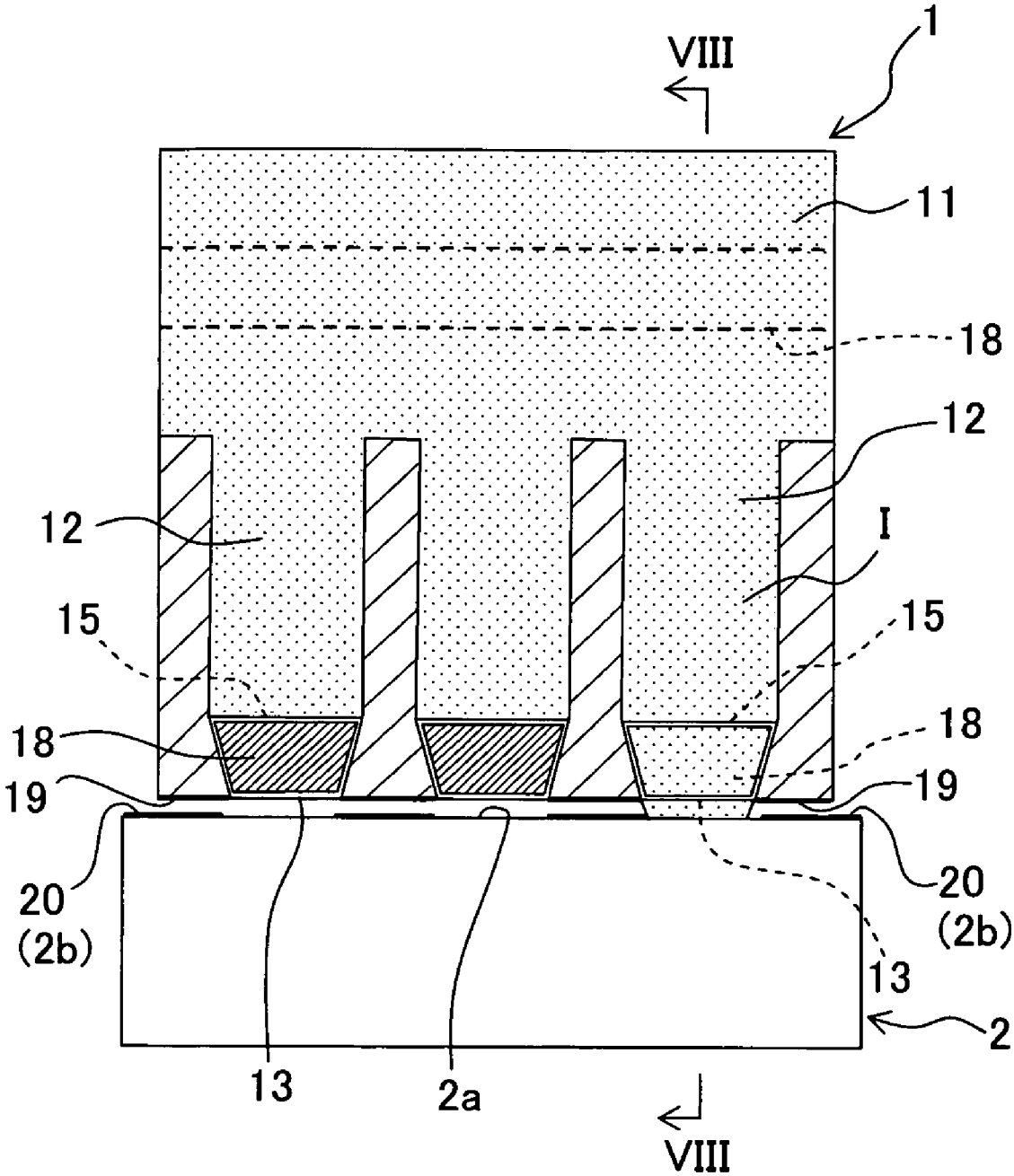
FIG. 7 is a cross-sectional view corresponding to FIG. 2 in a state in which the ink is discharged.
Figure 8:
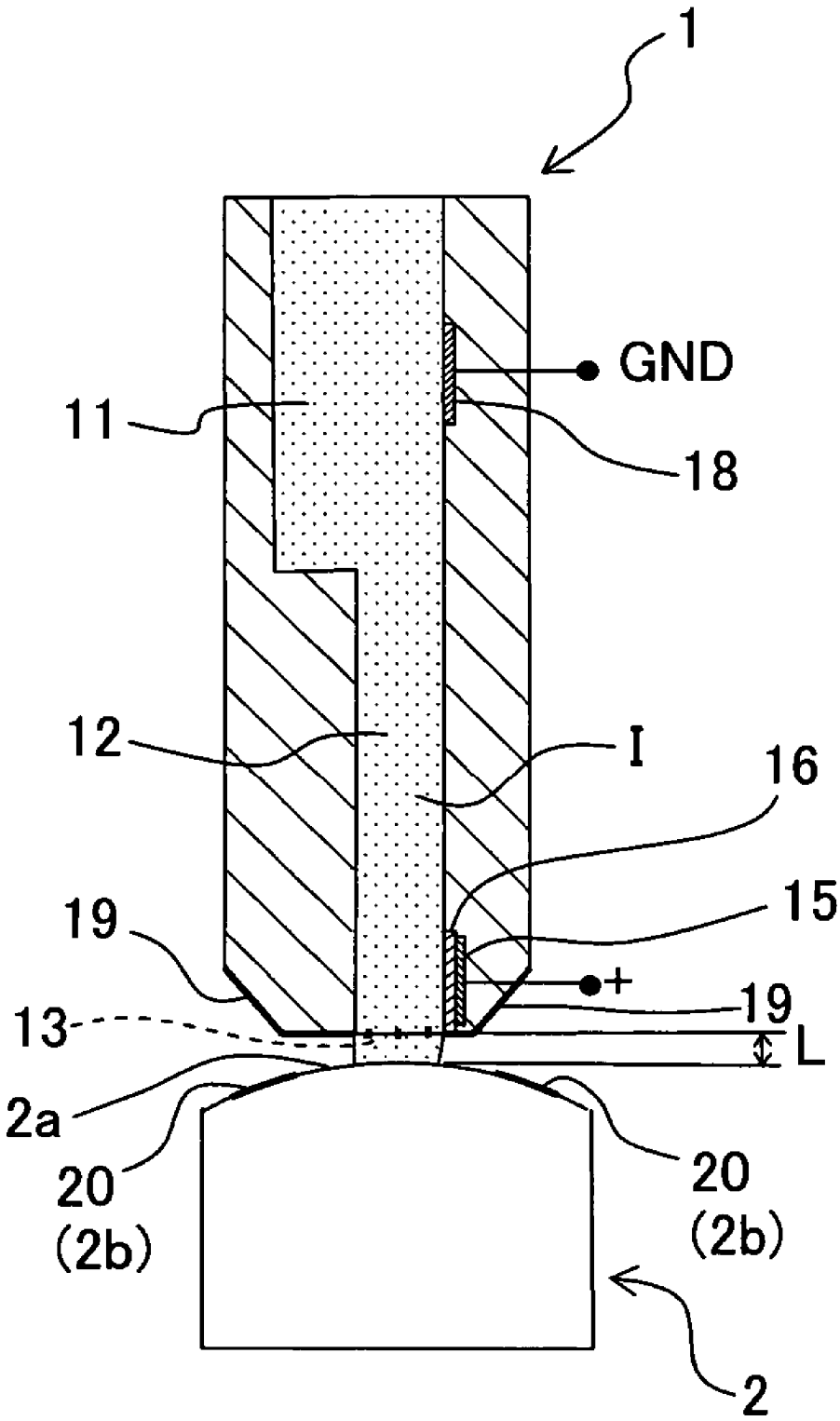
FIG. 8 is a cross-sectional view taken along a line VIII-VIII shown in FIG. 7.

Next, an ink transporting action of the ink transporting head 1 will be described by referring to FIG. 5 to FIG. 8. In FIG. 6 and FIG. 8, "+" signs of contact points of the individual electrodes 15 denote a state in which the voltage is applied to the individual electrodes 15, and "GND" denotes a state in which the voltage is not applied to the individual electrodes 15 (state of being at the ground electric potential).

In the state in which the drive voltage is not applied to the individual electrode 15 from the driver IC 17, the liquid repellent property of the surface of the insulating layer 16 becomes higher than a liquid repellent property of the inner surfaces of the individual ink channels 12. Therefore, as shown in FIG. 5 and FIG. 6, meniscuses of the ink I in the individual ink channels 12 which tend to flow downward cannot move to the discharge ports 13 by crossing over the surface of the insulating layer 16, and the ink I is not discharged from the discharge ports 13. However, when the drive voltage is applied to a certain individual electrode (the individual electrode 15 positioned at a right end in FIG. 7) from the driver IC 17, the liquid repellent property (wetting angle of ink) on the surface of the insulating layer 16 covering this individual electrode 15 is declined (electrowetting phenomenon), and the liquid repellent property of the surface of the insulating layer 16 becomes lower than the liquid repellent property of the inner surfaces of the individual ink channels 12. In this case, as shown in FIG. 7 and FIG. 8, the ink I can move downward up to the discharge ports 13 by wetting the surface of the insulating layer 16, and the ink I is discharged from the discharge ports 13 toward the transfer drum 2 on the lower side.

Since the ink in the manifold 11 is in contact with the common electrode 18 kept at the ground electric potential all the time, the electric potential of the ink in the individual ink channels 12 is not fluctuated. Consequently, when the drive voltage is applied to a certain individual electrode 15, a predetermined electric potential difference is generated assuredly between that individual electrode 15 and the ink. Therefore, in the individual ink channels 12, the ink can move smoothly to the discharge ports 13.

Moreover, as shown in FIG. 3 to FIG. 8, liquid repellent films 19 are provided in areas around the discharge ports 13 on a lower end of the head main body 10, and the liquid repellent property of the areas around the discharge ports 13 have become higher than the liquid repellent property of the inner surfaces of the individual ink channels 12 (liquid repellent property of the surfaces of the insulating films 16 when the drive voltage is applied to the individual electrodes 15). Therefore, the ink discharged form the ink ports 13 is prevented from adhering around the discharge ports 13.

Next, the transfer drum 2 will be described below. As shown in FIG. 1 and FIG. 2, the transfer drum 2 is formed to have the circular cylindrical shape having a length substantially same as a length of the ink transporting head 1, and is provided rotatably (and is rotatably supported) by the frame 4 of the printer 100. Moreover, the transfer drum 2 is rotated by driving in the clockwise direction in FIG. 2, by a drive motor not shown in the diagram.

The surface of the transfer drum 2 is close to the discharge ports 13 of the ink transporting head 1. Here, as shown in FIG. 8, a distance L between the ink transporting head 1 and the transfer drum 2 is set to be less than a diameter of a liquid droplet equivalent to ink discharged at a time from one discharge port 13, when the drive voltage is applied to the individual electrode 15 of the individual ink channel 12. In other words, the distance L isolating the ink transporting head 1 and the transfer drum 2 is less than a diameter of a spherical ink droplet having a volume same as a volume of the ink discharged at a time from one discharge nozzle 13. For example, when the volume of the ink discharged at a time from one discharge port 13 is approximately 5 p1, the distance L is set to be less than approximately 21 μm which is equivalent to the diameter of the droplet of ink having the volume of approximately 5 p1 (L=10 μm for example). Therefore, the ink discharged from the discharge port 13 is adhered assuredly to the surface of the transfer drum 2.

Figure 9:
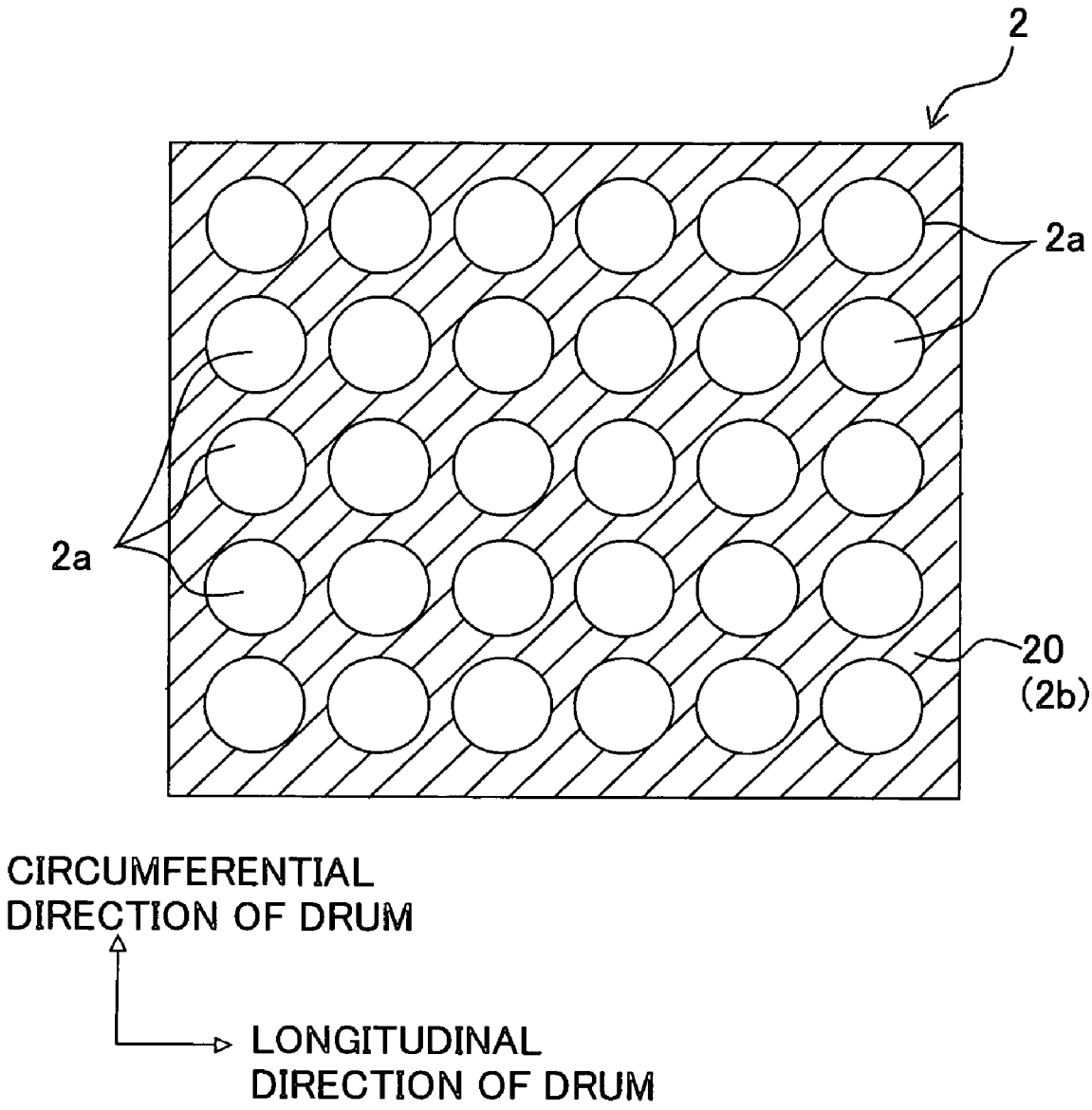
FIG. 9 is a partial development diagram of a surface of a transfer drum.

Moreover, as shown in FIG. 9, the surface of the transfer drum 2 is provided with a plurality of ink adhering areas 2*a* (liquid adhering areas) to which the liquid droplets which are discharged from each of the discharge ports 13 of the ink transporting head 1 are adhered. Moreover, the ink adhering areas 2*a* are surrounded (enclosed) by a liquid repellent film 20, and each of the ink adhering areas 2*a* has circular shape in a plan view. Furthermore, as shown in FIG. 9, the ink adhering areas 2*a* are arranged in a row in a longitudinal direction (left and right direction in FIG. 9) of the transfer drum 2, corresponding to the discharge ports 13, and a plurality of rows of the ink adhering areas 21*a* are arranged at equal intervals in a circumferential direction (vertical direction in FIG. 9) of the transfer drum 2. Moreover, the liquid repellent property of the ink adhering area 2*a* is lower than the liquid repellent property of the liquid repellent films formed around the discharge ports 13 of the ink transporting head 1. Therefore, the ink discharged from the discharge ports 13 are not adhered around the discharge ports 13, and are moved assuredly to the surface of the transfer drum 2.

Figure 10A:
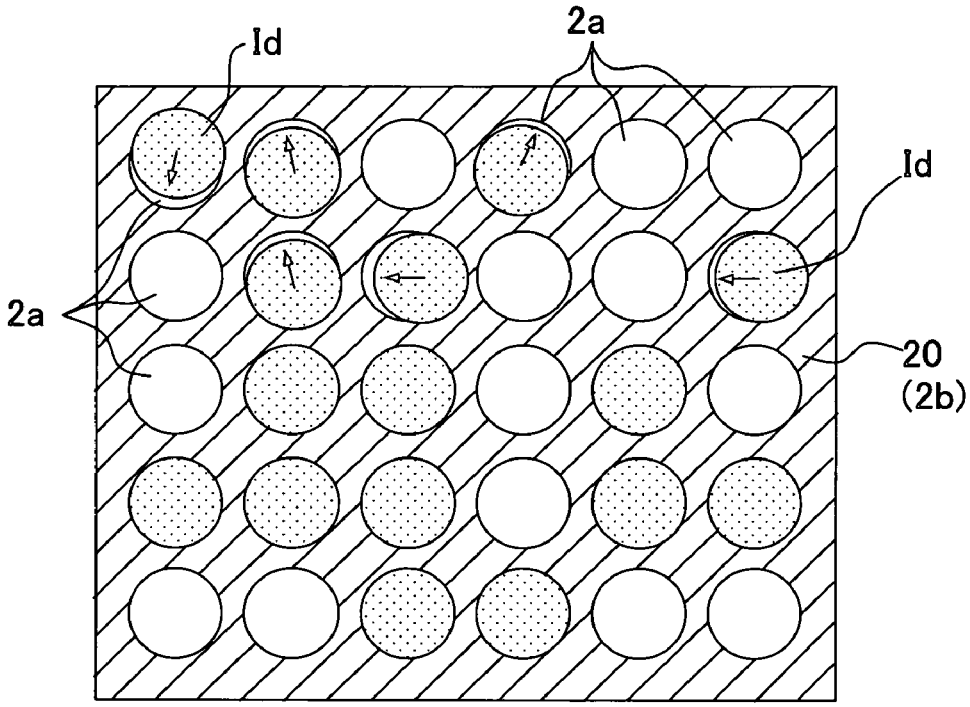
FIG. 10A is a partial development diagram of the surface of the transfer drum when the ink is adhered, showing a state immediately after the ink is adhered at a position shifted from an ink adhering area.
Figure 10B:
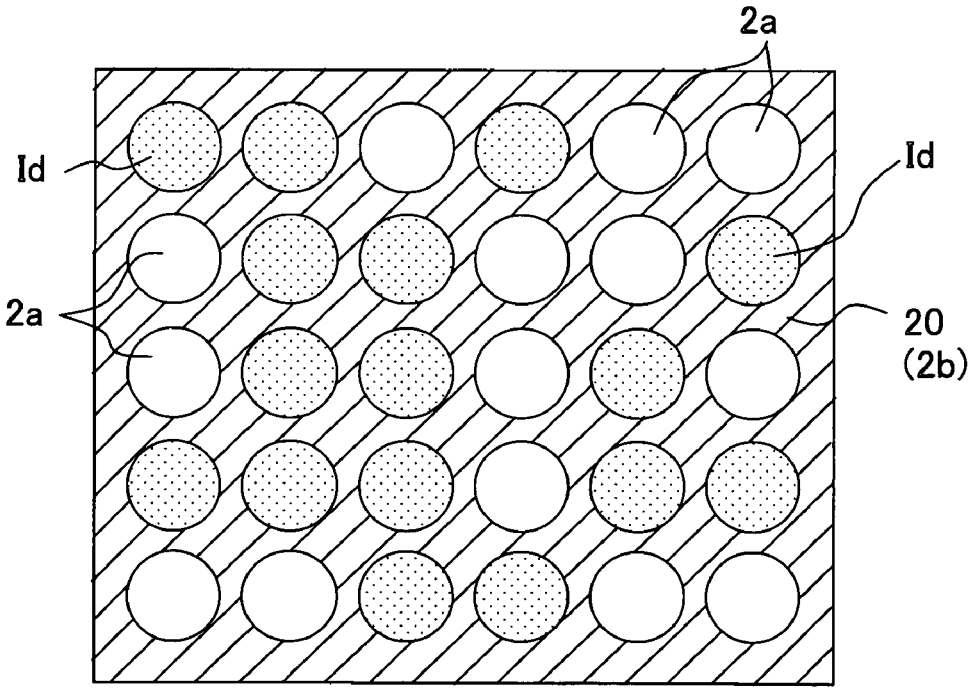
FIG. 10B is a partial development diagram of the surface of the transfer drum when the ink is adhered, showing a state in which the shifting of the ink adhering position is corrected.

Furthermore, the liquid repellent film 20 is formed on the surface of the transfer drum 2, in an area surrounding the ink adhering areas 2*a*, and forms a highly liquid repellent area 2*b* having the liquid repellent property higher than the liquid repellent property of the ink adhering areas 2*a*. Consequently, for example, when an ink droplet Id discharged from each of the discharge ports 13 is adhered to the transfer drum 2, in an unstable state, as shown in FIG. 10A, the ink droplet Id is sometimes shifted slightly from the ink adhering area 2*a* on the surface of the transfer drum 2 to which the ink droplet Id is to be adhered originally, and is adhered spreading even up to the highly liquid repellent area 2*b*. Even in such a case, as shown in FIG. 10B, the liquid droplet Id is moved automatically in a direction indicated by an arrow, from the highly liquid repellent area 2*b* which is highly liquid repellent, toward the ink adhering area 2*a* which is less liquid repellent. In other words, since the adhering position of the liquid droplet on the surface of the transfer drum 2 is corrected, the printing quality when the ink is transferred to the recording paper is improved.

Such shift in the adhering position of the liquid droplet occurs due to various factors such as an external force acting on the liquid droplet like the gravitational force and wind. However, in the printer 10 of this embodiment, as shown in FIG. 2, since the liquid transporting head 1 discharges (transports) the ink vertically downward from the discharge ports 13 toward the transfer drum 2, the shift in the adhering position due to the gravitational force acting on the liquid droplet does not occur. Moreover, for performing the correction mentioned above, the shift in the adhering position of the liquid droplet right before transferring to the recording paper is decreased substantially.

As shown in FIG. 2, the roller 7 is rotatably arranged to support the recording paper P from the lower side in order that the recording paper P is in contact with the lower end surface of the transfer drum 2. Moreover, the ink adhered to the transfer drum 2, after moving downward with the rotation of the transfer drum 2, is transferred assuredly to the recording paper P pinched between the transfer drum 2 and the roller 7.

According to the printer 100 mentioned above the following effects are achieved. The ink transporting head 1 transports the ink up to the discharge ports 13 by using a phenomenon of decline in the liquid repellent property of the surface of the insulating layer 16 which covers the individual electrodes 15, when the electric potential difference is generated between the individual electrodes 15 and the ink (electrowetting phenomenon). Therefore, as compared to a conventional ink-jet head having a complicated formation, a structure of the ink channels and a formation of the actuator which transports the ink are simplified, and it is possible to arrange the individual ink channels 12 and the discharge ports 13 highly densely. Therefore, a reduction in a size of the ink transporting head 1 is facilitated. Furthermore, it is possible to transport the ink at a comparatively low drive voltage.

Moreover, after the ink is made to be adhered to the surface of the transfer drum 2 from the ink transporting head 1, the ink on the surface of the transfer drum 2 is transferred to the recording paper P by rotating the transfer drum 2. Therefore, it is possible to make a predetermined amount of ink to be adhered stably to the recording paper P having a rough surface. Since the distance between the discharge port 13 of the ink transporting head 1 and the transfer drum 2 is less than the diameter of the liquid droplet equivalent to the amount of ink discharged at a time from the discharge port 13, the ink discharged from the discharge port 13 is adhered assuredly to the transfer drum 2.

Modified embodiments in which various modifications are made in the embodiment will be described below. However, same reference numerals are assigned to components having a similar structure as the structure of the components in the embodiment, and the description of such components is omitted.

First Embodiment

Figure 11:
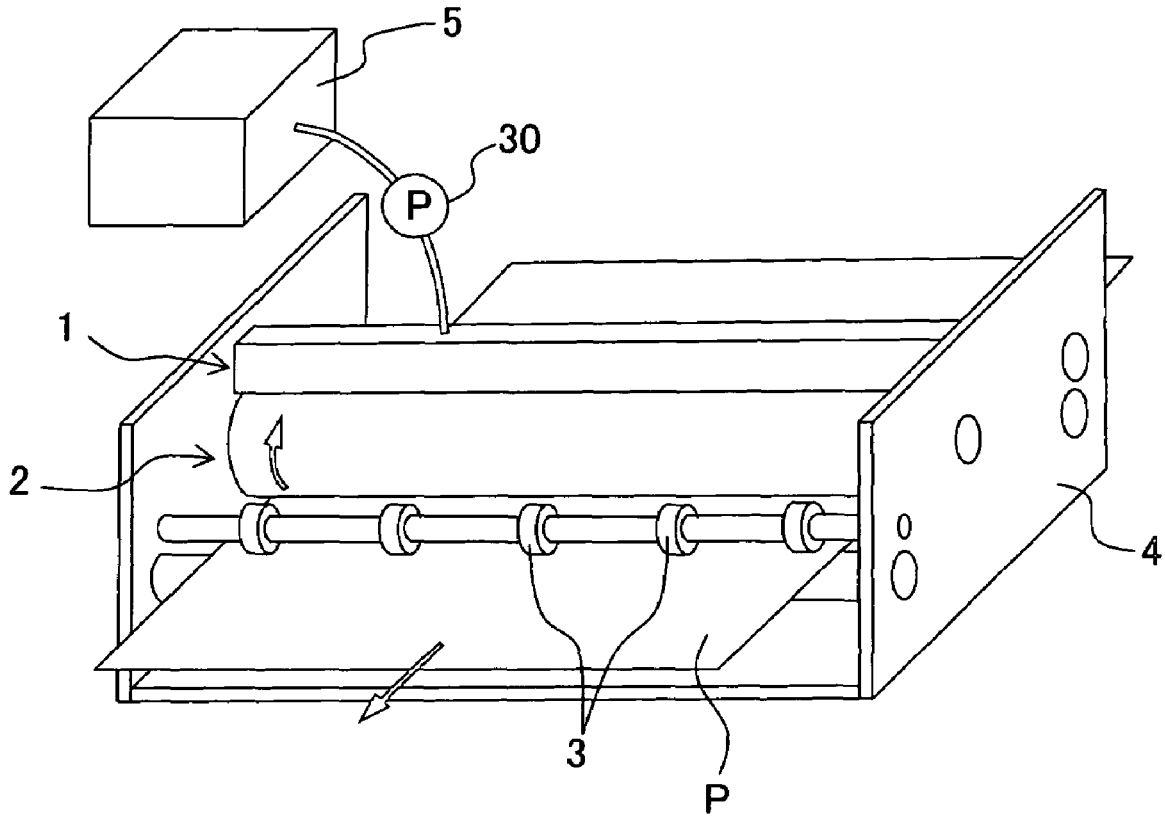
FIG. 11 is a schematic structural diagram of a printer of a first modified embodiment.

As shown in FIG. 11, a pressurizing pump 30 (booster pump) may be provided between the ink tank 5 and the ink transporting head 1, and the ink in the ink tank 5 may be pressurized by the pressurizing pump 30, and supplied to the ink transporting head 1. In this modified embodiment, since the pressure is applied to the ink in the ink transporting head 1 by the pressurizing pump 30, in addition to the gravitational force, the ink is susceptible to be discharged from the discharge ports 13 (refer to FIG. 2). Particularly, it is appropriate for a case in which there is no component of the gravitational force acting on the ink in the individual ink channels 12 toward the discharge ports 13 such as a case in which the discharge ports 13 of the ink transporting head 1 are toward a horizontal direction. It is also appropriate for a case in which the component of the gravitational force toward the discharge port 13 is small such as a case in which the discharge port 13 is toward a direction slightly inclined with respect to the vertical direction.

Second Modified Embodiment

Figure 12:
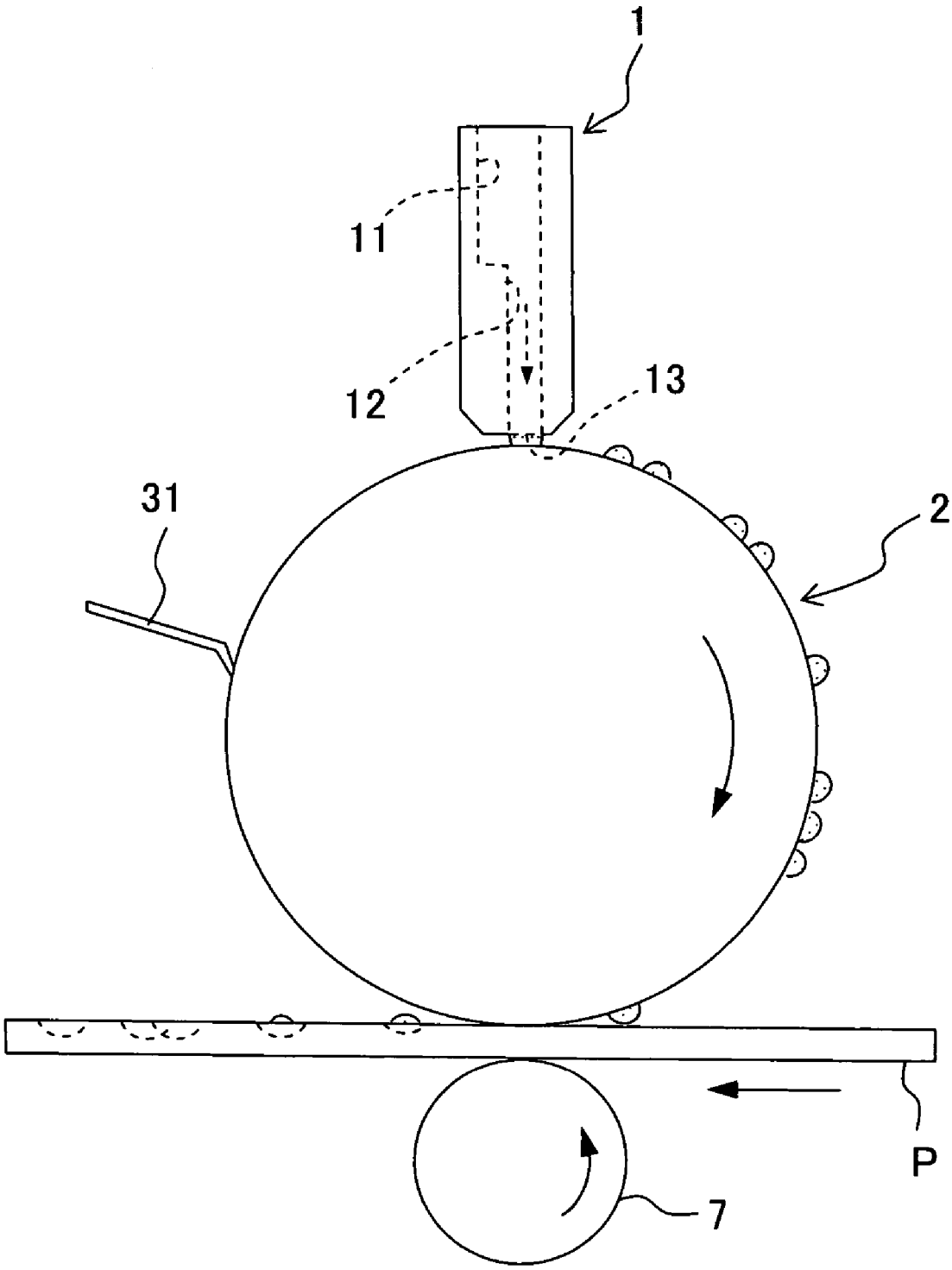
FIG. 12 is a side view corresponding to FIG. 2 of a printer of a second modified embodiment.

Sometimes, foreign matters (impurities) such as paper dust are adhered to a surface of the transfer drum 2 while transferring to a recording paper, and when it is left in a state in which the impurities are adhered, there is a possibility that the ink discharged from a discharge port 13 of an ink transporting head 1 may not be adhered to a predetermined ink adhering area of the surface of the transfer drum. Therefore, a foreign-matter removing mechanism which removes such foreign matters may be provided to the printer. For example, as shown in FIG. 12, a foreign-matter removing member 31 which is in contact with the surface of the transfer drum 2 all the time, may be provided along the longitudinal direction of the surface of the transfer drum 2 (direction perpendicular to a paper surface in FIG. 12). A front end of the foreign-matter removing member 31 is in contact with a portion (left side portion in FIG. 12) between an upper end portion of the transfer drum 2 to which the ink discharged from the ink transporting head 1 is adhered, and a lower end portion of the transfer drum 2 which comes in contact with the recording paper P. Therefore, till the subsequent ink is adhered after the ink is transferred to the recording paper P, the ink adhered to the surface of the transfer drum 2 can be scraped off by the foreign-matter removing member 31.

Third Embodiment

Figure 13:
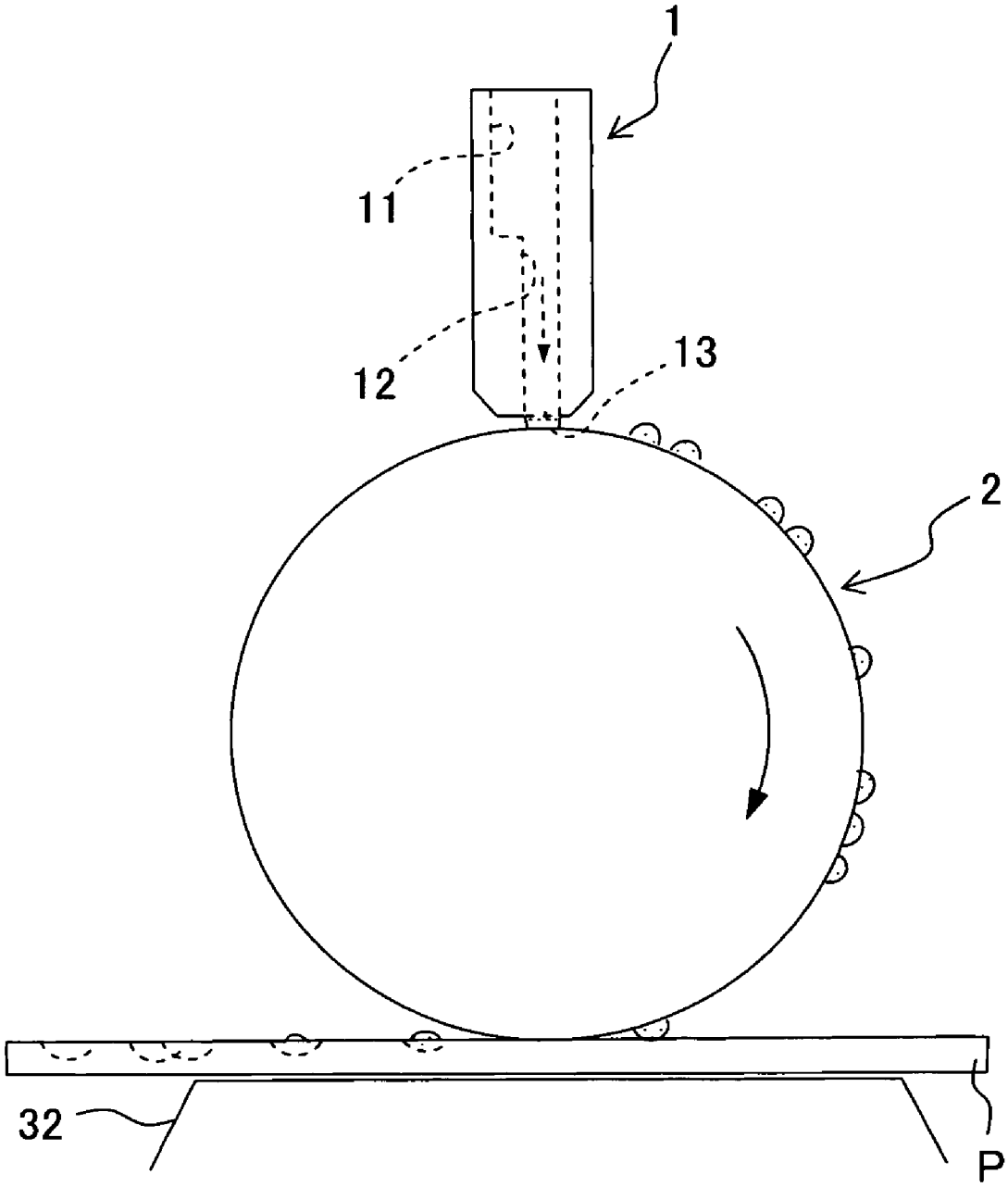
FIG. 13 is a side view corresponding to FIG. 2 of a printer in a first example of a third modified embodiment.
Figure 14:
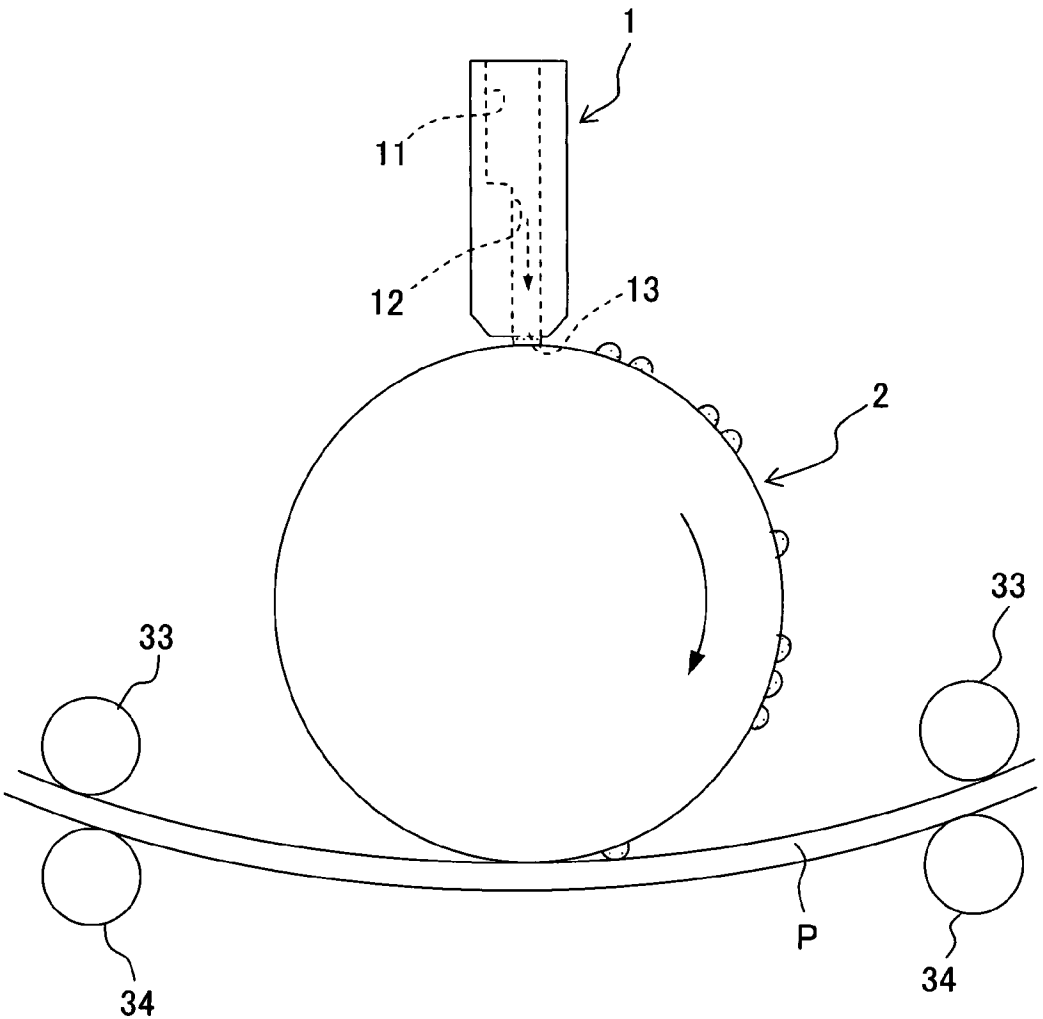
FIG. 14 is a side view corresponding to FIG. 2 of a printer in a second example of a third modified embodiment.

A structure supporting the recording paper P from the lower side such that the recording paper P which is carried is in contact with the transfer drum 2 all the time, is not restricted to the roller 7 of the embodiment (refer to FIG. 2), and various other structures may be used. For example, as shown in FIG. 13, the recording paper P may be supported by a horizontal supporting platform 32 which is arranged under the transfer drum 2. Or as shown in FIG. 14, the recording paper P may be supported by rollers 33 and 34 pinching the recording paper P from the upper side and the lower side, which are arranged on both sides (both left and right sides in FIG. 14) of a paper transporting direction, of the transfer drum 2.

Fourth Modified Embodiment

When the shift in the adhering position of the ink on the surface of the transfer drum 2 is small, the liquid repellent film 20 which is formed around the ink adhering areas 2*a* (refer to FIG. 9) for correcting the shift may be omitted.

Fifth Modified Embodiment

Figure 15:
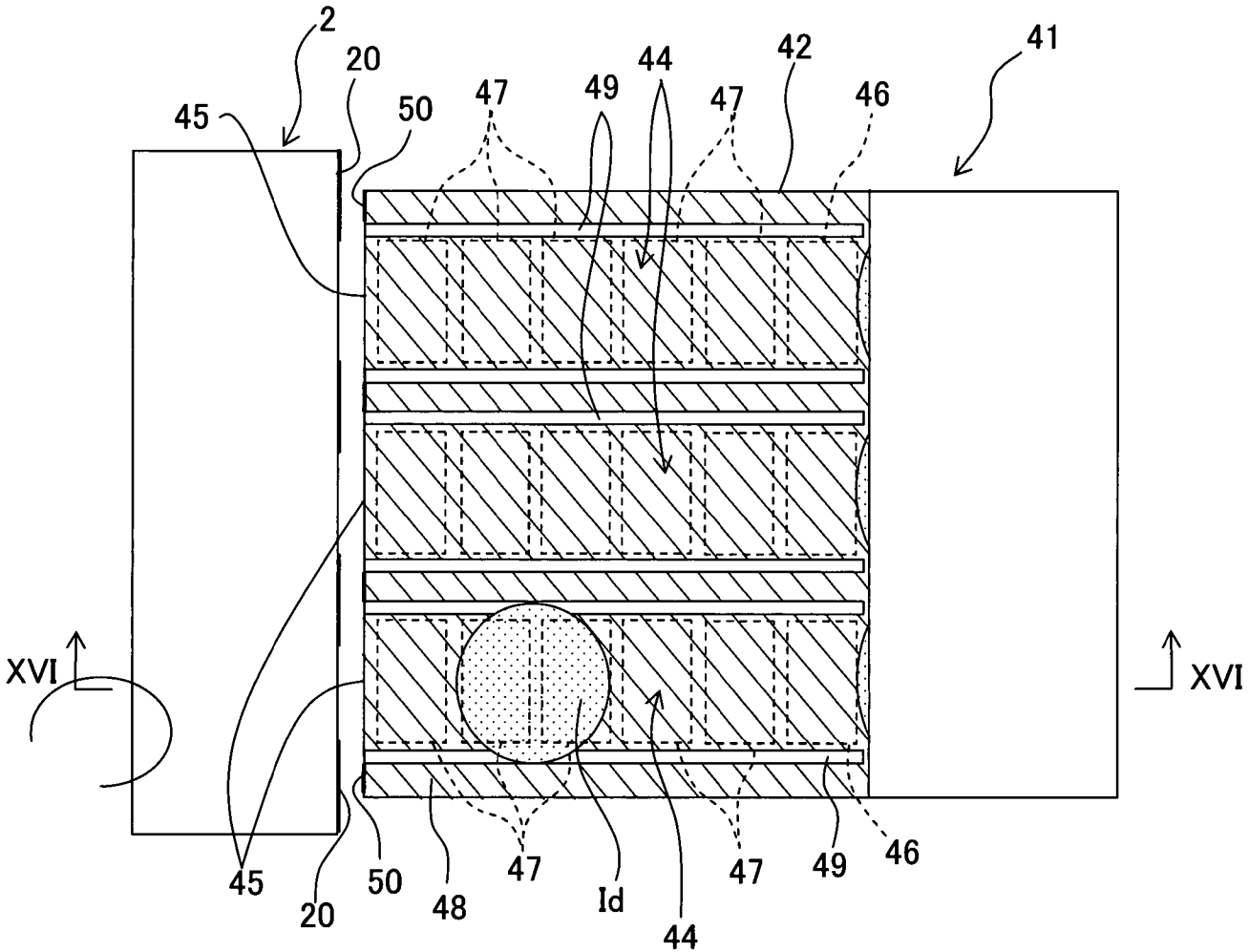
FIG. 15 is a partial plan view of a printer of a fifth modified embodiment.
Figure 16:
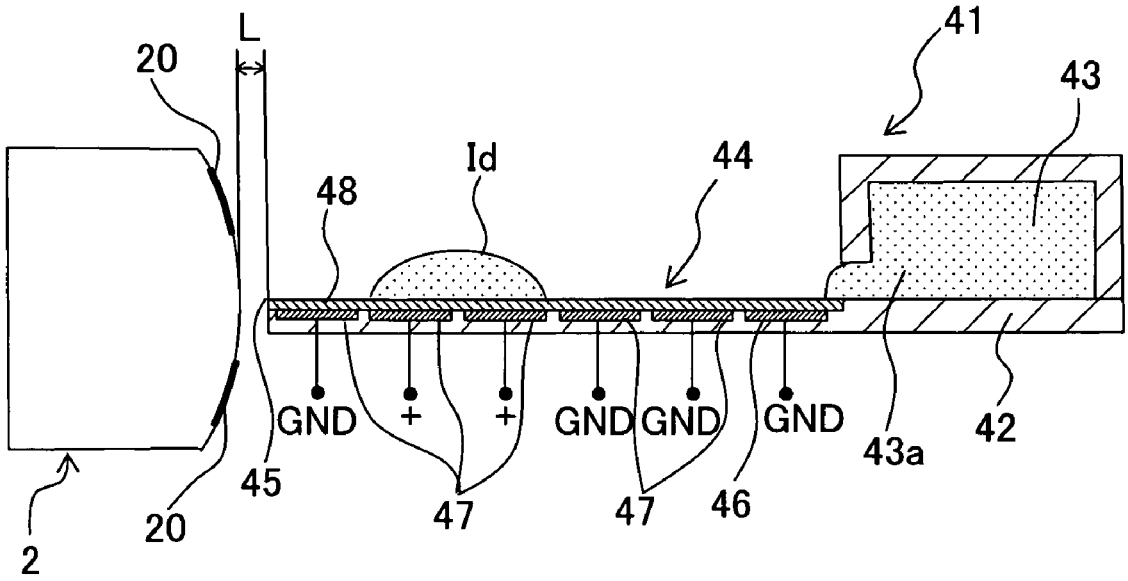
FIG. 16 is a cross-sectional view taken along a line XVI-XVI shown in FIG. 5.

An ink transporting head which transports the ink to the transfer drum by using the electrowetting phenomenon is not restricted to the ink transporting head 1 in the first embodiment, and ink transporting heads having various structures can be used. For example, an ink transporting head 41 shown in FIG. 15 and FIG. 16 includes an ink storage section 43, a plurality of individual ink channels 44, and a plurality of discharging sections 45. The ink storage section 43 is formed on an upper surface of an end portion of a substrate 42. The individual ink channels 44 are extended from a plurality of leading ports 43*a* of the ink storage section 43 to the transfer drum 2 respectively, on the upper surface of the substrate 42. Each of the discharging sections 45 is continued (communicates) with each of the individual ink channels 44.

Leading electrodes 46 are provided on the upper surface (channel forming surface) of the substrate 42 which forms each individual ink channel 44, adjacent to the leading ports 43*a* of the ink storage section 43. Furthermore, five transporting electrodes 47 are provided such that the five transporting electrodes 47 are arranged along a direction extending from a position adjacent to the leading electrodes 46 to the individual ink channels 44 respectively. The leading electrodes 46 and the transporting electrodes 47 are connected to a driver IC which is not shown in the diagram, and the driver IC can apply a drive voltage independently to each of the leading electrodes 46 and each of the transporting electrodes 47. The substrate 42 is formed of an insulating material, and the leading electrodes 46 and the transporting electrodes 47 are mutually insulated by the substrate 42. Moreover, an insulating layer 48 is formed continuously on the upper surface of the substrate 42 to cover the entire leading electrodes 46 and the transporting electrodes 47. Furthermore, a common electrode 49 which is extended in a direction in which the individual ink channels 44 are extended on both side of the individual ink channels 44 are formed on an upper surface of the insulating layer 48. The common electrode 49 is also connected to the driver IC, and is kept at the ground electric potential all the time via the driver IC.

When the drive voltage is not applied to the leading electrodes 46, a liquid repellent property of the insulating layer 48 covering the surface is higher than a liquid repellent property of an inner surface of the ink storage section 43 on which the insulating layer 48 is not formed, and the ink is not lead from the leading ports 43*a*. On the other hand, when the drive voltage is applied to the leading electrodes 46, since the liquid repellent property of the insulating layer 48 on the surface of the leading electrodes 46 becomes lower than the liquid repellent property of the inner surface of the ink storage section 43, the ink is lead from the leading ports 43*a* of the ink storage section 43. Furthermore, as the drive voltage applied to the leading electrodes 46 is released and the leading electrodes 46 come to the ground electric potential, when the drive voltage is applied to the transporting electrodes 47 adjacent to the leading electrodes 46 at the same time, the liquid repellent property of the insulating layer 48 on the surface of the leading electrodes 46 is improved (becomes superior) and the liquid repellent property of the insulating layer 48 on the surface of the transporting electrodes 47 is declined. Therefore, the ink on the leading electrodes 46 is moved to the transporting electrodes 47. Thus, by switching the leading electrodes 46 and the transporting electrodes 47 to which the drive voltage is applied, it is possible to transport the liquid droplet Id of ink lead from the leading ports 43*a* up to the discharging sections 45 along the individual ink channels 44, and to adhere it from the discharging sections 45 to the transfer drum 2. The ink storage section 43 and the individual ink channels 44 correspond to the liquid channel of the (patent) application for the present invention. Moreover, the leading electrodes 46 and the transporting electrodes 47 correspond to the first electrode of the application for the present invention, and the common electrode 49 corresponds to the second electrode of the application for the present invention.

Moreover, even in the ink transporting head 41 of the fifth modified embodiment, similarly as in the embodiment, the distance L between the discharging section of the ink transporting head 41 and the transfer drum 2 is less than the diameter of the (liquid) droplet Id of the ink having the volume same as the volume of the ink discharged at a time from one of the discharging sections 45. Furthermore, a liquid repellent film 50 is provided around the discharging sections 45, and the liquid repellent property around the discharging sections 45 is higher than the liquid repellent property of the surface of the transfer drum 2 and the upper surface of the substrate 42 (insulating layer 48) forming the individual ink channels 44. Therefore, the liquid discharged from the discharging section 45 is transported assuredly to the surface of the transfer drum 2 without adhering around the discharging sections 45.

Sixth Modified Embodiment

Figure 17:
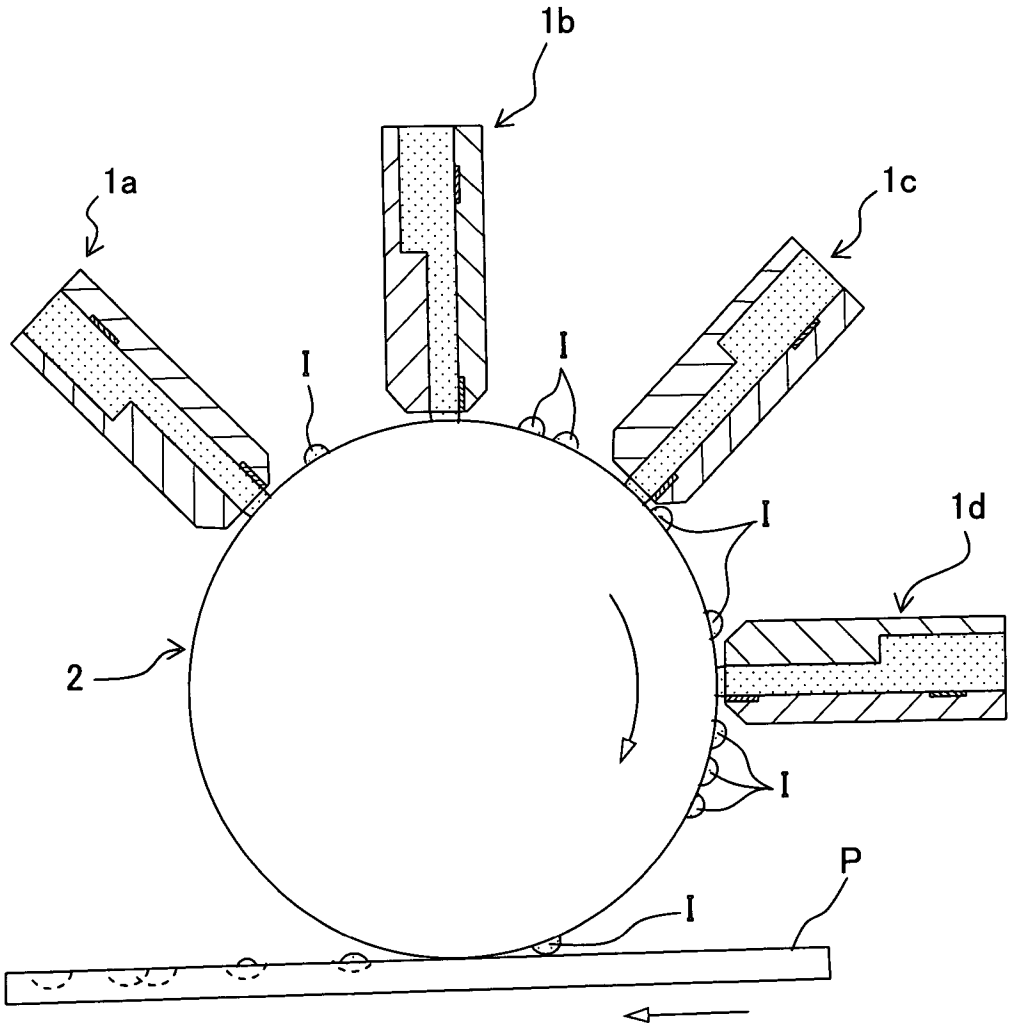
FIG. 17 is a side view corresponding to FIG. 2 of a printer of a sixth modified embodiment.

As shown in FIG. 17, four individual ink transporting heads (individual liquid transporting sections) 1*a* to 1*d* each having a structure same as the structure of the ink transporting head 1 may be arranged in a circumferential direction of the transfer drum 2. According to this structure, it is possible to record a color image on the recording paper P by discharging ink I of different color from each of the individual ink transporting heads 1*a* to 1*d*, then making the ink adhere to the transfer drum 2, and transferring to the recording paper P. The number and arrangement of the individual ink transporting heads may be voluntary.

Seventh Modified Embodiment

Figure 18:
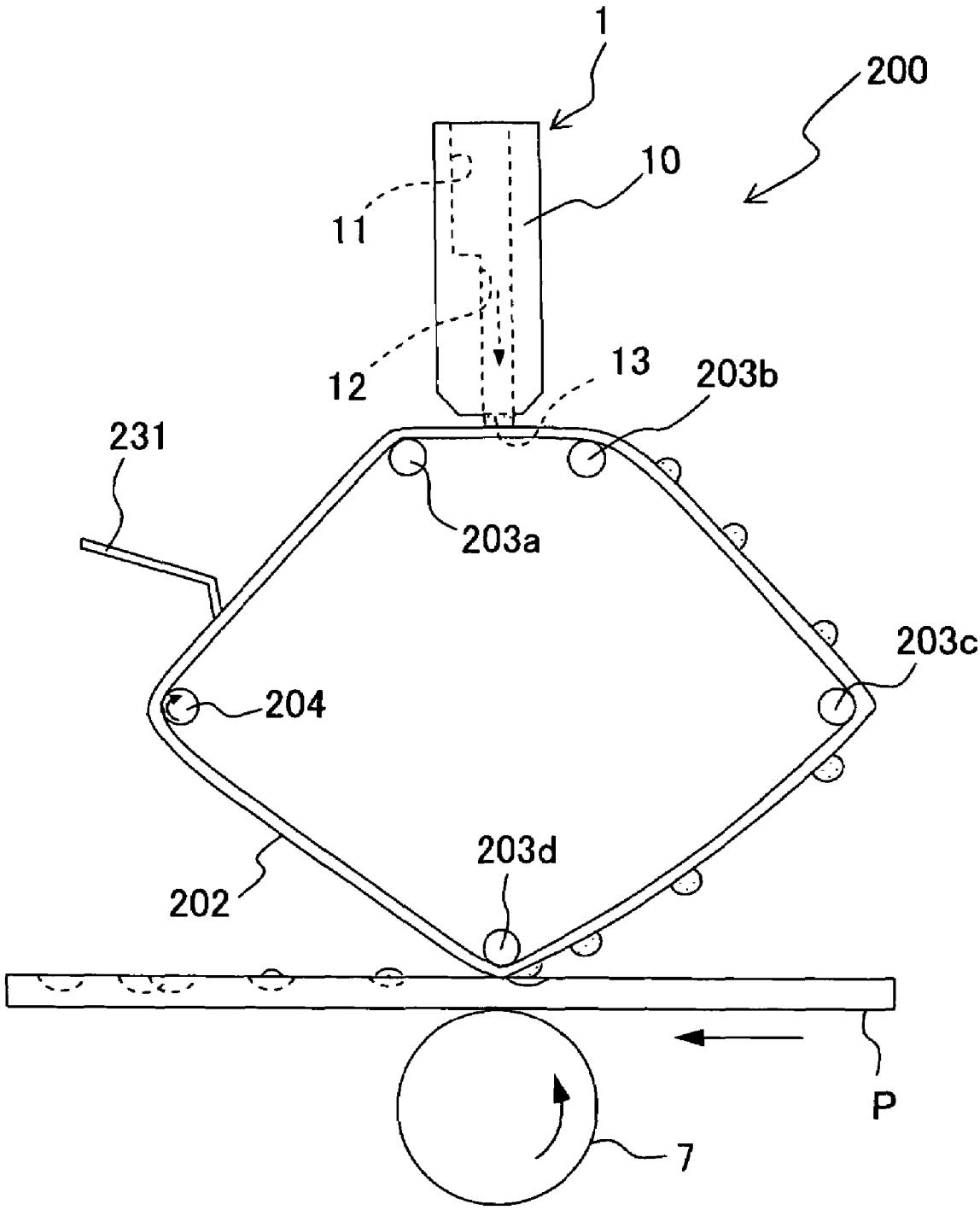
FIG. 18 is a side view corresponding to FIG. 2 of a printer of a seventh modified embodiment.

A printer 200 in a seventh modified embodiment has a structure similar to the structure of the printer 100 of the embodiment except for points that a transfer belt 202, spindle rollers 203*a* to 203*d*, and a belt rotating roller 204 are provided instead of the transfer drum 2 of the embodiment, and has an impurity removing mechanism 231 similar to the second embodiment. As shown in FIG. 18, the transfer belt 202 is arranged to make a contact with the spindle rollers 203*a* to 203*d*, and the belt rotating roller 204. Each of the spindle rollers 203*a* to 203*d* is rotatably supported by a core in the form of a rod which is not shown in the diagram, but extended in a direction of arrangement of the discharge port 13 of the ink transporting head 1. The belt rotating roller 204 is extended along the direction of arrangement of the discharge port 13 of the ink transporting head 1, and connected to a driving source which is not shown in the diagram. Moreover, the belt rotating roller 204 is rotatably pivoted by the frame 4 (refer to FIG. 1) of the printer 200. With the rotation of the belt rotating roller 204, the transfer belt 202 is rotated in a clockwise direction in FIG. 18. Here, a width of the transfer belt 202 is substantially the same as a length of the discharge port 13 of the ink transporting head 1 in the direction of arrangement. Moreover, the transfer belt 202 is arranged between the spindle rollers 203*a* and 203*b*, and uniformly spaced from the ink transporting head 1. Here, a distance between the transfer belt 202 and the ink transporting head 1 is less than a diameter of a spherical drop of ink having a volume same as the volume of the ink discharged at a time from the ink transporting head 1. Between the spindle roller 203*a* and 203*b*, the ink I discharged from the ink transporting head 1 is adhered to a surface of the transfer belt 202. The ink adhered to the surface of the transfer belt 202 is carried toward a lower side in FIG. 18, with the rotation of the transfer belt 202, and is transferred assuredly to the recording paper P pinched between the spindle roller 203*d* and the roller 7.

Figure 19:
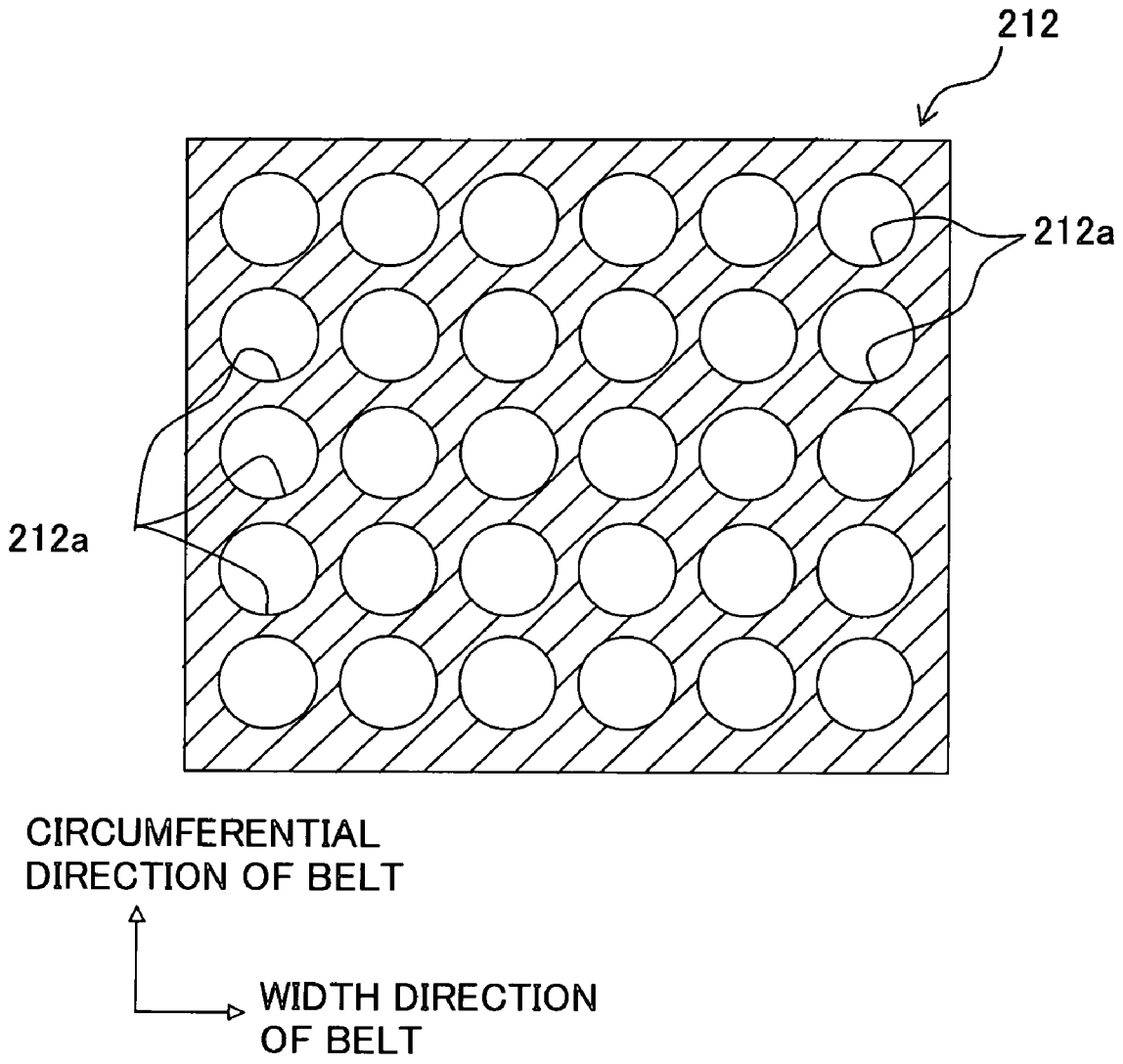
FIG. 19 is a partial development diagram of a transfer belt in which a hole is formed.

In the seventh modified embodiment, a shape, a material, the number and/or an arrangement of the spindle rollers, and the belt rotating roller may be voluntary. Moreover, also a shape, a material and/or a thickness of the transfer belt may be voluntary. Moreover, the modifications made in the other modified embodiments mentioned above can be applied also in the seventh modified embodiment. For example, an ink adhering area and a highly liquid repellent area as formed on the surface of the transfer drum in the embodiment may be formed on the surface of the transfer belt. Furthermore, as a transfer belt 212 shown in FIG. 19, a hole 212*a* may be formed in the transfer belt 212 in a portion corresponding to the ink adhering area. When the hole 212*a* is formed in the transfer belt 212 in the portion corresponding to the ink adhering area, the ink discharged from the ink transporting head 1 is carried in a state of being filled in the hole 212*a*, and is transferred to the recording paper P.

In the embodiment and the modified embodiments, a pattern of the ink adhering area and the highly liquid repellent area of the surface of the transfer belt and the transfer drum may be formed voluntarily. For example, the ink adhering area may be formed in the form of a line along the circumferential direction of the transfer drum and the transfer belt, or may be formed in the form of a line along a direction orthogonal to the circumferential direction. Or, the ink adhering area may be formed in the form of a lattice in both the circumferential direction and the direction orthogonal to the circumferential direction. Moreover, a transfer member (transfer mechanism) for transferring the ink discharged from the ink transporting head to a recording medium such as a recording paper, is not restricted to the transfer drum or the transfer belt, and any transfer member may be used.

The embodiment mentioned above is an example in which the present invention is applied to a printer which records an image by transferring the ink to the recording paper. However, the present invention is also applicable to other printing apparatuses which transfer a liquid other than the ink to a printing medium. For example, the present invention is also applicable to a printing apparatus which forms a wiring pattern by transferring an electroconductive liquid in which metallic nano particles are dispersed, to a substrate, a printing apparatus which manufactures DNA chips by using a solution in which a DNA is dispersed, a printing apparatus which manufactures a display panel by using a solution in which an EL light emitting material (luminescent material) such as an organic compound is dispersed, and a printing apparatus which manufactures a color filter for a liquid crystal display by using a liquid in which pigments for the color filter are dispersed. Moreover, a liquid used in these printing apparatuses is not restricted to an electroconductive liquid, and may be a liquid which has the electroconductive property similarly as the electroconductive liquid, by dispersing an electroconductive additive (addition agent) in a nonconductive liquid.

What is claimed is:

1. A printing apparatus which performs printing by discharging an electroconductive liquid onto a printing medium, comprising:

a liquid transporting section which includes a channel forming surface on which a liquid channel through which the liquid flows, and a discharging section communicating with the channel unit are formed, a first electrode which is arranged on the channel forming surface, and an insulating layer which is formed on a surface of the first electrode and which has a liquid repellent property higher than a liquid repellent property of the channel forming surface when no voltage is applied to the first electrode; and a transferring mechanism which transfers the liquid discharged from the discharging section of the liquid transporting section, to the printing medium, wherein a distance between the discharging section of the liquid transporting section and the transferring mechanism is less than a diameter of a liquid which is discharged at a time from the discharging section.

2. The printing apparatus according to claim 1, wherein the transferring mechanism is a transfer drum which is rotatably supported such that a surface of the transfer drum is close to the discharging section of the liquid transporting section.

3. The printing apparatus according to claim 2, wherein a liquid repellent property of the surface of the transfer drum is lower than a liquid repellent property of an area around the discharging section of the liquid transporting section.

4. The printing apparatus according to claim 2, wherein the surface of the transfer drum is provided with a liquid adhering area to which the liquid discharged from the discharging section is adhered, and a highly liquid repellent area which surrounds the liquid adhering area and has a liquid repellent property higher than a liquid repellent property of the liquid adhering area.

5. The printing apparatus according to claim 2, wherein a second electrode which is kept always at a predetermined electric potential, and which is in direct contact with the liquid, is formed on the channel forming surface.

6. The printing apparatus according to claim 2, wherein the liquid transporting section transports a liquid vertically downward from the discharging section toward the transfer drum.

7. The printing apparatus according to claim 2, wherein the liquid transporting section includes a plurality of individual liquid transporting sections arranged along a circumference of the transfer drum.

8. The printing apparatus according to claim 2, further comprising:

a foreign-matter removing mechanism which removes a foreign matter adhered to the surface of the transfer drum.

9. The printing apparatus according to claim 1, wherein the transferring mechanism is a transfer belt.

10. The printing apparatus according to claim 9, wherein a surface of the transfer belt defines an aperture to contain the liquid discharged from the liquid discharging section.

11. The printing apparatus according to claim 9, further comprising:

a foreign-matter removing mechanism which removes a foreign matter adhered to a surface of the transfer belt.

12. A printing apparatus which performs printing by discharging an electroconductive liquid onto a printing medium, comprising:

a liquid transporting section which includes a channel forming surface on which a liquid channel through which the liquid flows, and a discharging section communicating with the channel unit are formed, a first electrode which is arranged on the channel forming surface, and an insulating layer which is formed on a surface of the first electrode and which has a liquid repellent property higher than a liquid repellent property of the channel forming surface when no voltage is applied to the first electrode; and a transferring mechanism which transfers the liquid discharged from the discharging section of the liquid transporting section, to the printing medium, wherein a liquid repellent property of the surface of the transfer mechanism is less than a liquid repellent property of an area around the discharging section of the liquid transporting section.

* * * * *